US005996822A

United States Patent [19]

Hopkins

[11] Patent Number: 5,996,822

[45] Date of Patent: Dec. 7, 1999

[54] MEDICINE CABINET ORGANIZER

[76] Inventor: Edward Hopkins, 38 Lockspring, San Antonio, Tex. 78250

[21] Appl. No.: 09/115,816

[22] Filed: Jul. 15, 1998

[51] Int. Cl.[6] ..... A47F 5/00

[52] U.S. Cl. ..... 211/134; 211/135; 211/128.1; 211/90.04; 312/351; 108/92

[58] Field of Search ..... 211/193, 90.04, 211/135, 90.01, 128.1; 108/92; 312/351, 245

[56] References Cited

U.S. PATENT DOCUMENTS

| | | | |
|---|---|---|---|
| D. 154,438 | 7/1949 | Spano . | |
| 1,886,532 | 11/1932 | Davidson | 211/135 |
| 2,099,906 | 11/1937 | Reese et al. . | |
| 2,197,870 | 4/1940 | Krasberg | 211/90.04 |
| 2,536,059 | 1/1951 | Igler | 211/90.04 |
| 2,690,266 | 9/1954 | Johnson . | |
| 3,264,049 | 8/1966 | Peterson . | |
| 3,521,936 | 7/1970 | Cooker . | |
| 4,134,625 | 1/1979 | Palka . | |
| 4,283,099 | 8/1981 | Burton | 312/351 |
| 4,378,070 | 3/1983 | Matheis | 211/135 X |
| 5,139,322 | 8/1992 | Aisley . | |
| 5,524,980 | 6/1996 | Carter et al. . | |
| 5,664,689 | 9/1997 | Mirlisena, Sr. . | |
| 5,775,523 | 7/1998 | Teringo . | |

*Primary Examiner*—Robert W. Gibson, Jr.
*Attorney, Agent, or Firm*—Royston, Rayzor, Vickery, Novak & Druce, L.L.P.

[57] ABSTRACT

An organizer for medicines, toiletries, and other similarly-sized articles adapted as a free-standing frame adapted to fit inside a household medicine cabinet, with a horizontal base panel forming a lowermost of a plurality of shelves. The base panel and each shelf being attached to a back panel. Preferably, each of the shelves is incrementally less deep than the next lower shelf and incrementally less wide that the next lower shelf to facilitate visibility of the stored items to the user and to facilitate access to stored items by the user. Peferably, the base panel and each shelf has a rim along its front edge to prevent stored items from falling off the front edge. At least one of surfaces of the organizer is mirrored and others are transparent to increase visibility of stored items the user. The organizer is formed of materials amenable to cleaning with common household surface cleaning products.

8 Claims, 1 Drawing Sheet

MEDICINE CABINET ORGANIZER

FIELD OF THE INVENTION

Figure 1:
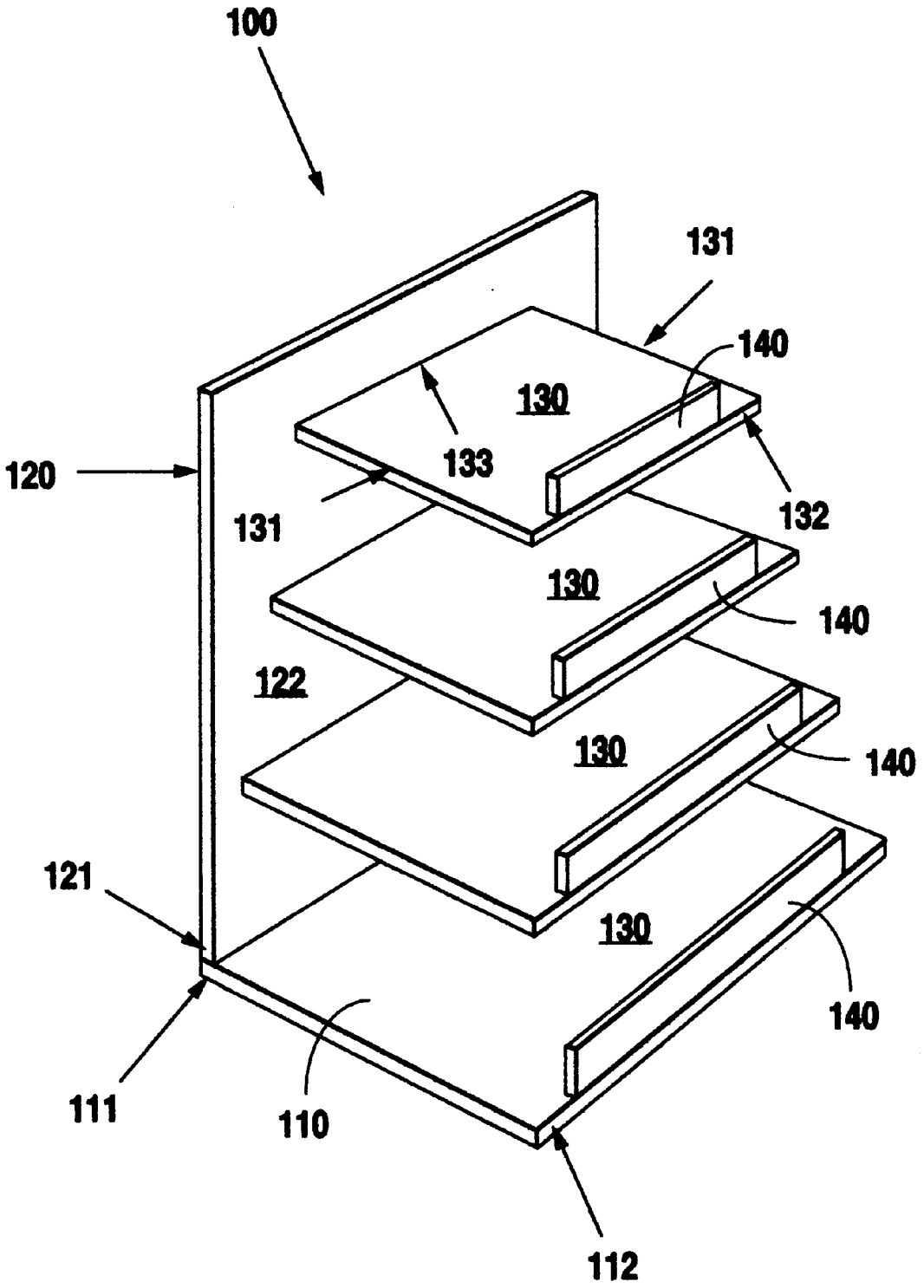

This invention relates generally to organizers. More specifically, the invention pertains to a free-standing organizer for a household medicine cabinet.

BACKGROUND INFORMATION

Cabinets for storing medicines, toiletries, and similarly-sized articles, i.e., medicine cabinets, are well known. Medicine cabinets typically provide a plurality of shelves, each of which span the cabinet's full interior width. Typically, the shelves may be installed at a limited number vertical positions within the medicine cabinet. The distance between any two adjacent shelves must be great enough to accommodate the tallest item stored upright on the lower of the two shelves.

However, adjusting the vertical distance between full width shelves to accommodate the tallest item stored upright on the lower of two adjacent shelves typically results in inefficient use of the remainder of space between those shelves. Even with the ability to adjust the vertical distance between shelves, access to small items stored in the medicine cabinet and visibility of those items may be hampered by the construction of the medicine cabinet. Further, stored items may fall off a shelf.

Typical solutions to increase utilization of the space inside a medicine cabinet include replacing the entire medicine cabinet with one which allows more efficient use of space or fixedly installing an organizer inside the existing medicine cabinet using fasteners or adhesives. While enabling more efficient use of space inside the cabinet, such approaches still have disadvantages, e.g., visibility and accessibility of stored items may continue to be hampered; de-installation and subsequent re-installation of the organizer may be required for complete cleaning; stored items may fall off the front of a shelf; the organizer may not be adapted to use outside the medicine cabinet. The need exists for an organizer that addresses these drawbacks.

Therefore, in view of this need and potential benefits to be enjoyed in addressing these drawbacks, the present invention has been designed and developed.

SUMMARY OF THE INVENTION

The present invention is organizer for medicines, toiletries, and other similarly-sized articles. The organizer enables increased efficiency in the use of medicine cabinet space and increases visibility and accessability of items stored thereon over typical organizers. It also is easily removable for complete cleaning with common household surface cleaning products and may be used free-standing outside a cabinet.

The organizer is adapted to fit as a free-standing frame inside a household medicine cabinet. The organizer has a substantially horizontal base panel base panel, forming a lowermost shelf of the organizer, connected at its back edge to a substantially vertical back panel. A plurality of shelves are attached to the front surface of the back panel above the base panel on the same side of the back panel as the base panel.

In the illustrated embodiment, each of the shelves is incrementally less deep than the next lower shelf and incrementally less wide that the next lower shelf to facilitate visibility of the stored items to the user and to facilitate access to stored items by the user. In the illustrated embodiment, the base panel and each shelf has a rim along its front edge to prevent stored items from falling off the front edge. In alternative embodiments at least one of surfaces of the organizer is mirrored to increase visibility of stored items the user. Also in alternative embodiments, the shelves and front rims are constructed from transparent material to increase visibility of stored items to the user. In all embodiments, the organizer is formed of materials amenable to cleaning with common household surface cleaning products.

DESCRIPTION OF THE DRAWINGS AND ILLUSTRATIVE PHOTOGRAPHS

FIG. 1 is a perspective view of the preferred embodiment of the present invention.

DESCRIPTION OF THE INVENTION

Based on the description and illustrations provided herein, the many benefits provided by the invented structure are apparent. These described benefits, as well as those that are inherent to those skilled in the art, fall within the scope of the invention of the present patent application as limited only by the claims appended hereto.

Referring to FIG. 1, the preferred embodiment of an organizer 100 for medicines, toiletries, and other similarly-sized articles is shown. The organizer 100 is essentially a free-standing frame formed of materials amenable to cleaning with common household surface cleaning products. The organizer 100 has a substantially vertical-planar back panel 120, connected at its lower edge 121 to the rear edge 111 of a substantially horizontal-planar base panel 110. A plurality of substantially horizontal-planar shelves 130 project substantially normal to the back panel 120 from the back panel's front surface 122, with the base panel 110 forming the lowermost shelf. Each shelf 130, including the base panel 110, is provided with a rim 140 along its front edge 112 (base panel front edge), 132 (shelf front edge) to deter stored items from falling off the shelf 130, 110. Each shelf 130 above the base panel 110 is less deep and less wide than the next lower shelf 130, 110 for aiding in a user's visual location of items 300 stored in the organizer 100 and to aid in access to stored items 300. While in the preferred embodiment the organizer 100 appears to be formed of discrete components connected together, the organizer 100 may also be of unitary construction. Some elements of the organizer, e.g., shelves 110 above the base 120 and rims 140, may be formed of transparent material so as to leave items stored thereon substantially visible. Other elements, e.g. the back panel 120 and the base panel 130 may be mirrored for aiding in a user's visual location of items stored in the organizer 100.

The organizer 100 is of dimensions to fit in a typical household medicine cabinet while leaving room inside the medicine cabinet taller items. In one alternative embodiment of the organizer, each of the shelves 110 above the base panel 130 is of substantially the same width and depth and the entire organizer 100 is formed of transparent material for aiding in a user's visual location of items stored in the organizer 100. In a second alternative embodiment of the organizer 100, the back panel 120 is mirrored to reflect generally toward the shelves 130, the base panel 110 is mirrored to reflect generally upward, and the shelves 130 above the base panel 110 along with the rims 140 are transparent; all to aid in the user's visual location of items stored in the organizer.

I claim:

1. An organizer, for toiletries and other similarly-sized articles, adapted to fit as a free-standing frame inside a houseold medicine cabinet, said organizer comprising:

a substantially planar base panel substantially horizontally oriented, said base panel forming a lowermost shelf of said organizer;

a substantially planar back panel oriented subsantially upright and connected at a lower edge of said back panel to a back edge of said base panel;

a plurality of substantially planar shelves arranged above said base panel and substantially parallel to said base panel, wherein a rear edge of each of said plurality of shelves is attached to a front face of said back panel, and each of said plurality of shelves has a width measured between two side edges of said shelf and a depth measured from a front side of said shelf to said front surface of said back panel; and a rim extending upwardly substantially vertical from at least one of said shelves.

2. The organizer as recited in claim 1 wherein at least one of said plurality of shelves above said base is less deep than each shelf therebelow.

3. The organizer as recited in claim 1 wherein at least one of said plurality of shelves above said base is less wide that each shelf therebelow.

4. The organizer as recited in claim 1 wherein said rim has a height less than the space between said shelf to which it is attached and a next higher shelf.

5. The organizer as recited in claim 1 wherein said back panel is mirrored to reflect in a direction of said shelves for aiding in a user's visual location of items stored in said organizer.

6. The organizer as recited in claim 1 wherein at least one of said shelves is mirrored for aiding in a user's visual location of items stored in said organizer.

7. The organizer as recited in claim 1 wherein at least one of said shelves are constructed of transparent material for aiding in a user's visual location of items stored in said organizer.

8. The organizer as recited in claim 1 wherein at least one of said rims is constructed of transparent material for aiding in a user's visual location of items stored in said organizer.

* * * * *